United States Patent [19]

Simons et al.

[11] Patent Number: 5,016,717

[45] Date of Patent: May 21, 1991

[54] VACUUM EXCAVATOR

[75] Inventors: Billy R. Simons, Arcadia, Kans.; Ben K. Turner, Macks Creek; James T. Brell, Camdenton, both of Mo.

[73] Assignee: Aqua-Vac Locators, Inc., Camdenton, Mo.

[21] Appl. No.: 322,998

[22] Filed: Mar. 14, 1989

[51] Int. Cl.[5] ..... E21B 7/18; E21C 25/60

[52] U.S. Cl. ..... 175/66; 175/67; 175/206; 175/213; 175/424; 299/17

[58] Field of Search ..... 175/66, 67, 424, 206, 175/207, 208, 213; 299/17; 37/195, 1; 404/91, 75

[56] References Cited

U.S. PATENT DOCUMENTS

| | | | |
|---|---|---|---|
| 2,605,090 | 7/1952 | Jacobsen | 299/17 X |
| 3,395,467 | 8/1968 | Allen et al. | 37/195 |
| 3,968,845 | 7/1976 | Chaffin | 175/213 X |
| 3,993,354 | 11/1976 | Kilroy | 299/17 X |
| 4,167,292 | 9/1979 | Eller | 299/17 X |
| 4,434,861 | 3/1984 | Howeth | 175/206 X |
| 4,637,656 | 1/1987 | Medest | 299/17 X |
| 4,761,037 | 8/1988 | Medest | 299/17 X |
| 4,795,217 | 1/1989 | Hilario | 299/17 X |
| 4,813,611 | 3/1989 | Fontana | 175/424 X |

FOREIGN PATENT DOCUMENTS

| | | | |
|---|---|---|---|
| 221730 | 5/1987 | European Pat. Off. | 299/17 |
| 208335 | 3/1909 | Fed. Rep. of Germany | 175/67 |
| 899965 | 2/1982 | U.S.S.R. | 299/17 |

*Primary Examiner*—Hoang C. Dang

*Attorney, Agent, or Firm*—Litman, McMahon & Brown

[57] ABSTRACT

An excavation apparatus includes a suction system with a suction tank pneumatically connected to a blower through a filter subassembly. A suction hose is pneumatically connected to the suction tank. A liquid jet system includes a liquid reservoir fluidically connected to a liquid pump, which in turn is fluidically connected to a spray wand. The suction and liquid jet systems are mounted on a vehicle. An excavation method includes the steps of dislodging earthen material with a liquid jet from the spray wand and sucking it into the suction tank with the suction system.

20 Claims, 5 Drawing Sheets

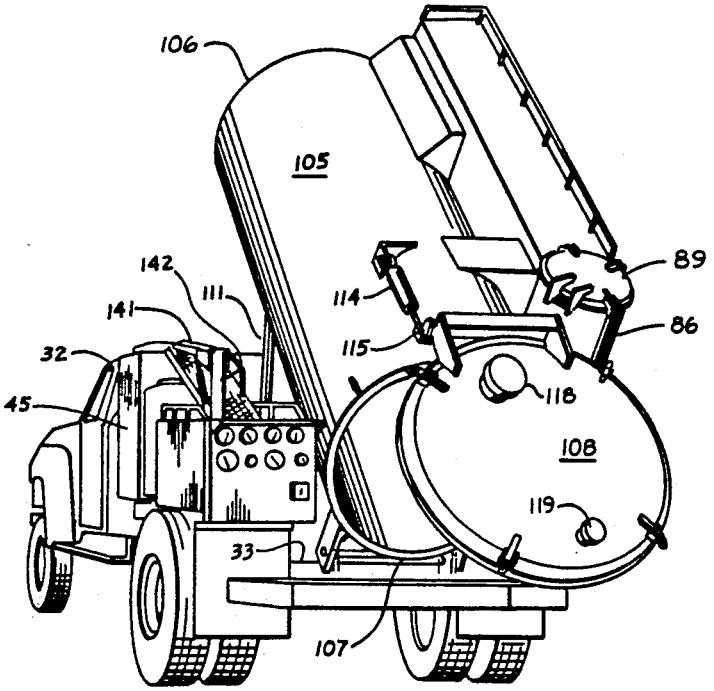
Fig. 4.
Fig. 5.
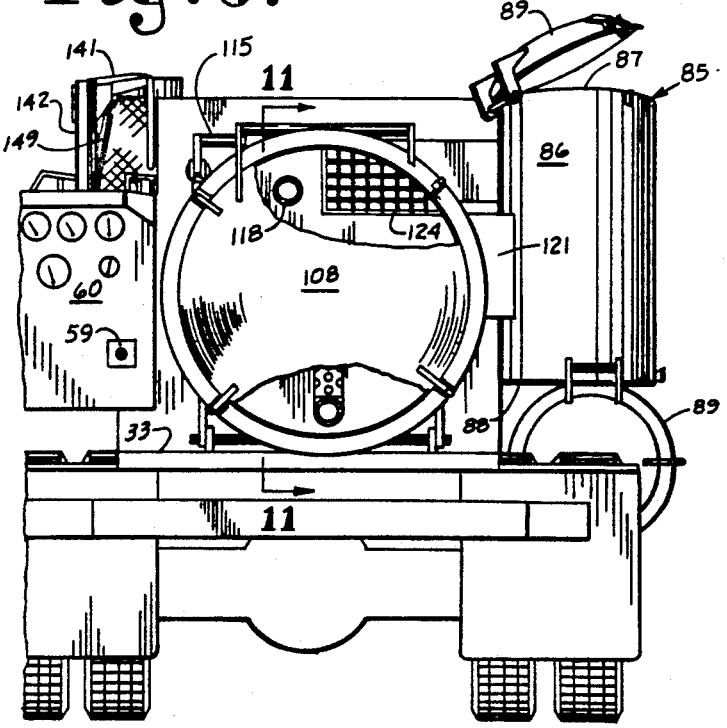
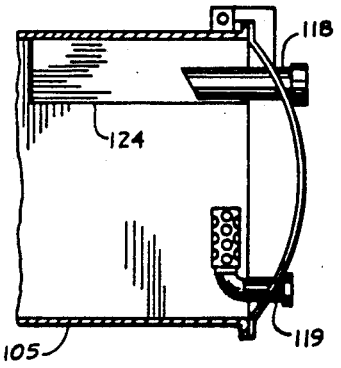
Fig.11.

VACUUM EXCAVATOR

BACKGROUND OF THE INVENTION

1. Field of the Invention

The present invention relates generally to excavation, in particular to hydraulic excavation and more particularly to hydraulic excavation combined with suction for removing liquid and dislodged matter.

2. Description of the Prior Art

Various excavation methods and equipment have heretofore been employed. Mechanical excavation devices range from simple hand tools such as picks and shovels to sophisticated earth moving equipment for scraping, trenching, drilling and otherwise excavating in various soil conditions.

Fluids have also been employed for excavation. For example, "Air-Knife" and "Water Cannon" excavation equipment is available from Briggs Technology, Inc. of Pittsburg, Pa. Hydraulic mining, trenching, dredging and digging devices for underwater applications are shown in the Jacobson U.S. Pat. No. 2,605,090; the Norman U.S. Pat. No. 4,087,981; the Kocher U.S. Pat. No. 4,412,394; and the Berti et al. U.S. Pat. No. 4,479,741. The dredging head disclosed in the Kocher '394 patent has suction capabilities so that material dislodged by its water jets can be withdrawn from the dredged area.

Large scale suction equipment is also used for removing concrete rubble dislodged by concrete water-blasters, for cleaning sewers and for other waste removal applications. Truck-mounted vacuum equipment for such applications is available from General Liquid Engineering, Inc. of Ontario, Canada.

However, the aforementioned excavation equipment and methods have disadvantages when used for certain excavation projects, such as locating buried utility cables and lines. Hand tools tend to be relatively slow and are often associated with relatively high labor costs, particularly if a relatively large volume of material must be excavated or relatively deep excavation is required. Furthermore, a hand tool may damage the utility cable or line.

Excavating with power equipment, such as backhoes and drilling machines, tends to be faster and less labor-intensive than excavating by hand, but is often attended by a greater risk of cable or line damage. Buried cables and lines are particularly susceptible to damage by backhoe operators. For this reason, excavation with a backhoe in a utility right-of-way may be impractical unless the operator has relatively accurate information on the depth and location of the subsurface line or cable. Otherwise the operator may be completely unaware that a utility line or cable has been exposed until it is severed. Severing a pipeline filled with a flammable material such as natural gas can be quite hazardous, as is severing an electrical line. Even if no personal injury results from severing a utility line or cable, property damage repair costs will often be incurred. Such repair costs may intitially be incurred by either the utility or the excavator, but either way they may be passed on to the consuming public in the form of higher utility, excavation or insurance costs.

Fiber optics telecommunications cables in particular are associated with heavy financial losses in the event they are severed. The revenue loss to a telecommunications company while its fiber optics cable is being repaired, and the cost of the repair itself, combine to impose an enormous liability on any party responsible for severing or otherwise damaging such a cable.

Fiber optics cables are normally buried in trenches along rights-of-way at depths sufficient to minimize the risk of accidental damage. However, fiber optics cables may share rights-of-way with other utility cables and lines. Servicing these utilities and lines often involve excavation in proximity to the buried fiber optic cables. The trenches may be formed with conventional trenching equipment and may be approximately three feet wide. Cable depths of approximately four to five feet are often specified, but the actual depths of the buried cables vary widely. Manholes are typically provided along the cable routes, and may occur at intervals of approximately four miles each.

When excavation work must be done in a right-of-way containing a fiber optic cable, it is often desirable to accurately determine the location of the fiber optic cable so that the excavator can avoid damaging it. However, the exact location of a cable buried between the manholes can be difficult to determine. Earth movement and settling may have shifted the cable from its original location and render it difficult to locate. Furthermore, the absence of ferrous metals and current-carrying conductive wires from a fiber optic cable can preclude or at least minimize the suitability of magnetic and current-detecting locating devices. Thus, locating buried fiber optic cables often requires physically exposing them. In this manner their locations can be determined with relative precision. Between the manholes the cable right-of-way is typically "potholed" by excavating at predetermined intervals to expose the buried cable. If only the cable location is desired, a large opening is generally unnecessary. Potholing may be accomplished with hand tools, machines or both. However, since hand tools are relatively slow and equipment use is attended by a risk of cable damage, both methods have their drawbacks. The excavation apparatus and method of the present invention address these problems.

SUMMARY OF THE INVENTION

In the practice of the present invention a mobile excavation apparatus is provided and includes a vehicle with an engine. A liquid jet system includes a liquid pump drivingly connected to the engine. A spray wand with a nozzle is fluidically connected to the liquid pump and is adapted for dispensing a jet of liquid for dislodging material in an excavation. A suction system includes a blower driven by the engine and a suction tank pneumatically connected to the blower whereby a partial vacuum may be formed therein. A suction hose is connected to an inlet of the suction tank and may be placed in an excavation for educting fluid and dislodged material.

In the practice of the excavation method of the present invention, the suction system and the liquid jet system are operated simultaneously to dislodge material in the excavation and draw it to the suction tank. The depth of the excavation is advanced by placing progressively longer extensions on the suction hose and the spray wand.

OBJECTS AND ADVANTAGES OF THE INVENTION

The principal objects and advantages of the present invention include: providing a mobile excavation apparatus; providing such an apparatus with a hydraulic jet system; providing such an apparatus with a spray wand for directing the hydraulic jet; providing such an apparatus with a suction system for collecting and retaining liquid and dislodged material from an excavation; providing such an apparatus wherein the hydraulic jet and the suction systems can be operated simultaneously; providing such an apparatus with a suction tank for retaining liquid and other matter drawn from the excavation; providing such an apparatus wherein the suction tank may be tilted for dumping; providing such an apparatus which is adapted for locating subsurface objects, such as fiber optic cables, with minimum risk of damage thereto; providing such an apparatus which can be self-contained as a single mobile unit; providing such an apparatus which can be operated by one person; providing such an apparatus which can excavate relatively small diameter openings to depths of several feet; providing such an apparatus which is economical to manufacture, efficient in operation, capable of a long operating life and particularly well adapted for the proposed usage thereof; providing an excavation method; providing such an excavation method wherein excavated material is simultaneously dislodged and educted; providing such an excavation method which can be practiced by one person; providing such an excavation method which minimizes damage to subsurface objects, such as fiber optic cables; providing such an excavation method which involves forming a relatively small diameter opening to depths of several feet; and providing such an excavation method which is efficient, relatively easy to practice, and particularly well adapted for the proposed applications thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is a left rear perspective view of the excavation apparatus, shown with the suction tank thereof in a raised, dump position.

FIG. 5 is a rear elevational view thereof with portions of the suction tank broken away to reveal internal construction.

FIG. 11 is an enlarged, vertical, cross-sectional view thereof taken generally along line 11—11 in FIG. 5.

DETAILED DESCRIPTION OF THE PREFERRED EMBODIMENTS

I. General Description and Environment

Figure 1:
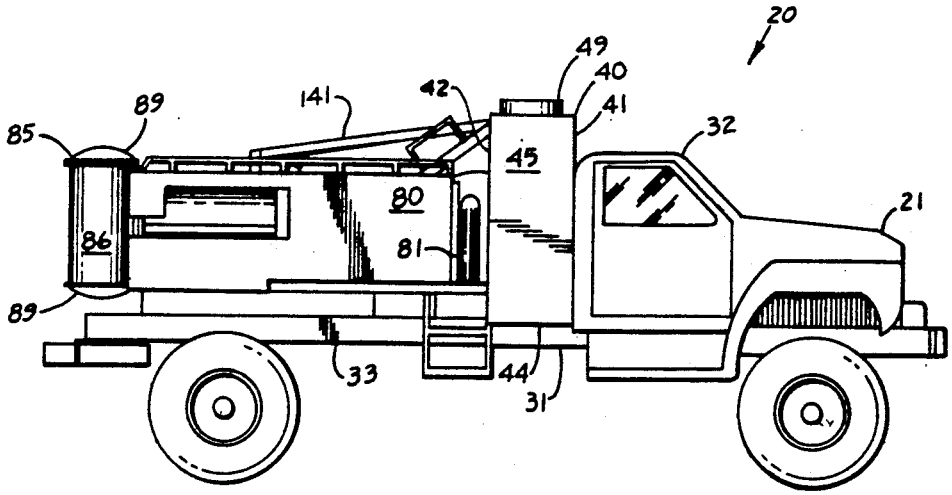
FIG. 1 is a right side elevational view of an excavation apparatus embodying the present invention, shown with a suction tank thereof in a lowered, working position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 20 generally designates a mobile excavation apparatus embodying the present invention. The apparatus 20 generally includes a base vehicle 21, a hydraulic jet system 22 and a suction system 23.

Without limitation on the generality of useful applications of the excavation apparatus 20, an exemplary application described herein involves excavating and locating a fiber optic cable 26 below a ground surface 27 of an earthen mass 28 comprising soil and fill material (e.g. rocks, gravel, sand, clay, etc.) such as might be encountered in a trench T for laying the buried cable 26 in. The earthen mass 28 may be disintegrated into dislodged particles 29 by hydraulic action as described below.

II. Base Vehicle 21

Without limitation on the generality of suitable installations for the excavation apparatus 20, it is shown and described installed on a base vehicle 21 comprising a truck with a chassis 31 mounting a cab 32 and a rear bed 33. The chassis 31 also mounts an internal combustion engine 34 which is adapted for driving the truck 21 through a transmission 35 with a power takeoff (PTO) 36. A variety of vehicles could be successfully employed with the excavation apparatus of the present invention. Exemplary factors to be taken into account when selecting an appropriate vehicle include:

(1) air resistance;
(2) rolling resistance;
(3) grade resistance;
(4) engine characteristics, including sufficient power to move the fully-loaded unit at a desired road speed at a cruising speed for the engine (generally about ninety-percent of maximum engine speed). The engine must also develop sufficient power for the other systems, i.e. the hydraulic jet and the suction systems;
(5) transmission design including ratio steps within the engine's "power band" or operating range and suitability for off-road conditions and inclines that are likely to be encountered in service;
(6) altitude where the unit is likely to be used;
(7) ambient temperatures where the unit is likely to be used;
(8) chassis cab design;
(9) drive train efficiency;

(10) center of gravity height;
(11) road surface conditions;
(12) truck surface facilities;
(13) fuel prices; and
(14) weight distribution.

The truck 21 includes a suitable electrical system for powering certain electrical components of the excavation apparatus 20.

As an alternative to the truck 21, either or both of the hydraulic jet and suction systems 22, 23 could be mounted on a towed vehicle, such as a trailer. An appropriate tow vehicle could then be selected for the field conditions that would be encountered. For example, a full-track or half-track tow vehicle might be preferred for work in particularly muddy field conditions. Suitable vehicles with floatation tires could be utilized if necessary.

III. Hydraulic Jet System 22

The hydraulic jet system 22 includes a liquid reservoir 40 transversely mounted on the vehicle chassis 31 behind the cab 32. The reservoir 40 is generally rectangular with a front 41, a back 42, a top 43, a bottom 44 and opposite sides 45. A reservoir interior 48 is accessible through a reservoir hatch 49. The reservoir interior 48 is adapted to receive and retain a liquid L, which may comprise water. The liquid L could also comprise bentonite, which has barrier-forming properties and is often used as a pond sealer and as a drilling fluid for well drilling. Furthermore, the liquid L could include or comprise various other substances for expediting the excavation process.

Heater means 51 may be provided in the reservoir 40 and may comprise, for example, a section of exhaust pipe 52 communicating heated exhaust gasses from the engine 34 with the liquid L. Exhaust pipe section 52 enters the reservoir 40 through its bottom 44 and exits through its top 43. The exhaust pipe section 52 may have a serpentine configuration as shown for providing an effective heat exchange with the liquid L.

A liquid pump 55 is drivingly connected to the power takeoff 36 of the transmission 35 and communicates fluidically with the liquid reservoir 40. A pump discharge conduit 57 extends from a discharge side of the pump 55 to a coupling 59 which may be mounted on a panel 60 at a back of the vehicle 21 or at any other suitable location.

A spray wand hose 61 may be releaseably connected to the discharge conduit 57 by means of the coupling 59. A suitable spray wand 62 is fluidically coupled to the spray wand hose 61. Several spray wands 62 are preferably provided for forming excavations of various depths. Without limitation on the generality of useful spray and discharge devices, the spray wand 62 may include a pistol grip 63, a manually-operated valve trigger 64, a barrel 65 and a discharge nozzle 66. The barrel 65 may comprise several interconnectable and interchangeable sections 65*a, b, c* of relatively rigid steel pipe with an inside diameter (I. D.) of approximately one quarter inch. The nozzle 66 can be selected for desired excavating and soil cutting characteristics.

IV Suction System 23

The suction system 23 includes a pneumatic blower 70, e.g. a double-lobe type blower. A hydraulic blower drive subsystem 71 includes a hydraulic pump 72 drivingly connected to the engine 34, a reservoir 73, a hydraulic motor 74 and a hydraulic radiator 75.

Figure 12:
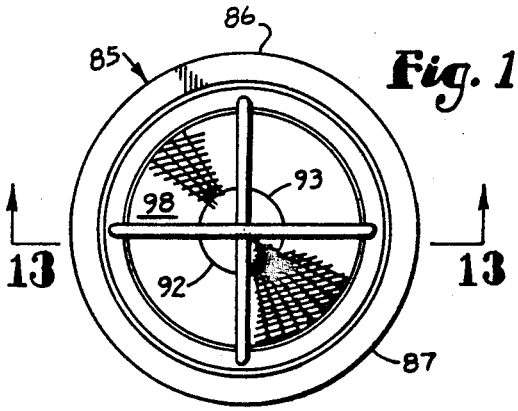
FIG. 12 is an enlarged, top plan view of a separator subassemby thereof.
Figure 13:
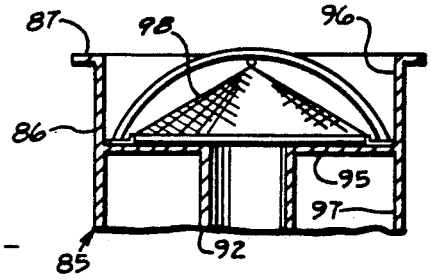
FIG. 13 an enlarged, vertical, cross-sectional view thereof taken generally along line 13—13 in FIG. 12.
Figure 10:
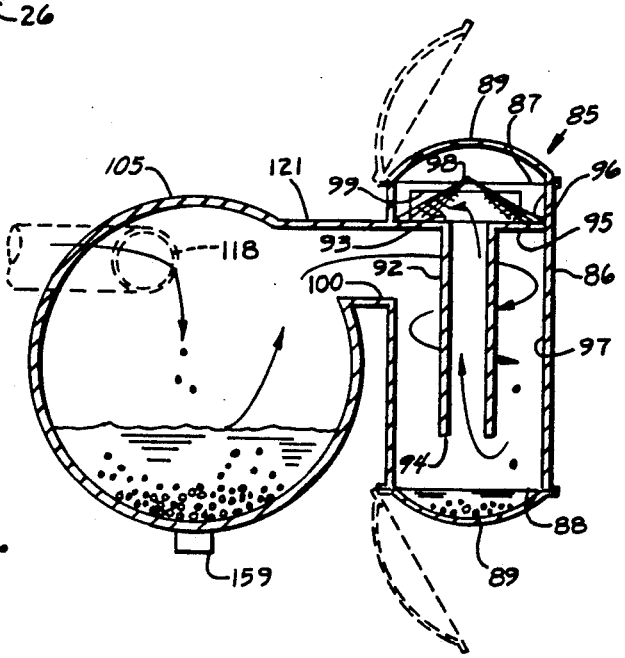
FIG. 10 is a vertical, cross-sectional view thereof taken general along line 10—10 in FIG. 3.

A blower outlet duct 78 extends from a discharge side of the blower 70 to a suction system discharge 79. A filter housing 80 is provided on one side of the vehicle 21 and communicates with the blower 70 by means of a blower inlet duct 81. The filter housing 80 encloses a pair of bag filter subassemblies 84 and mounts a separator subassembly 85. The separator subassembly 85 (FIGS. 10, 12 and 13) includes a cylindrical body 86 with upper and lower ends 87, 88 which are selectively closed by hatches 89. An internal separator tube 92 is coaxially positioned within the interior of the separator body 86 and includes upper and lower ends 93, 94 in spaced relation from the body upper and lower ends 87, 88 respectively. An annular plate 95 extends between the body 86 and the separator tube upper end 93. The plate 95 demarcates upper and lower separator chambers 96, 97. A conical filter or screen 98 is placed on the plate 95 over the separator tube upper end 93. A separator outlet 99 communicates the separator upper chamber 96 with the filter housing 80 and a separator inlet 100 communicates with the separator lower chamber 97 immediately below the plate 95.

Figure 2:
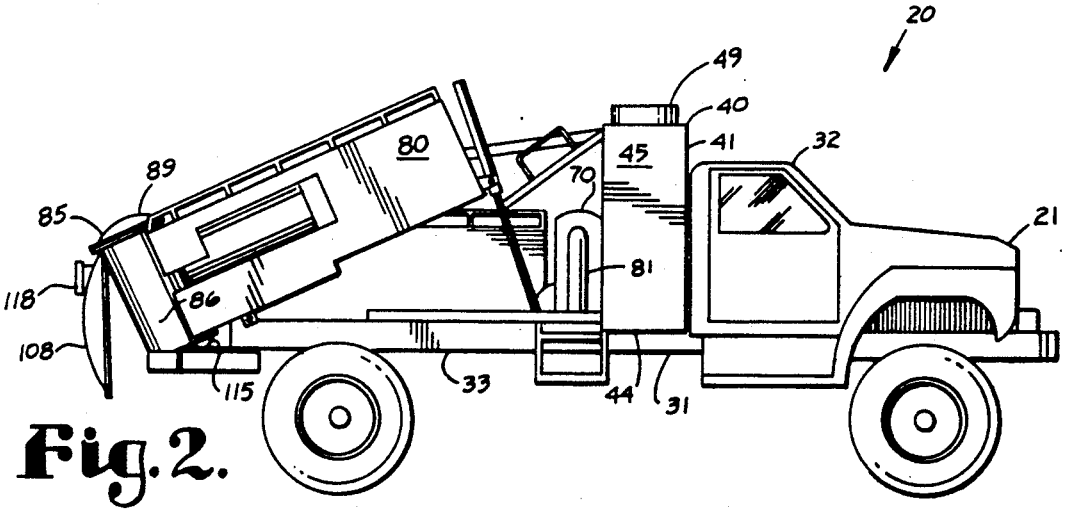
FIG. 2 is a right side elevational view of the excavation apparatus, shown with the suction tank thereof in a raised, discharge position.
Figure 3:
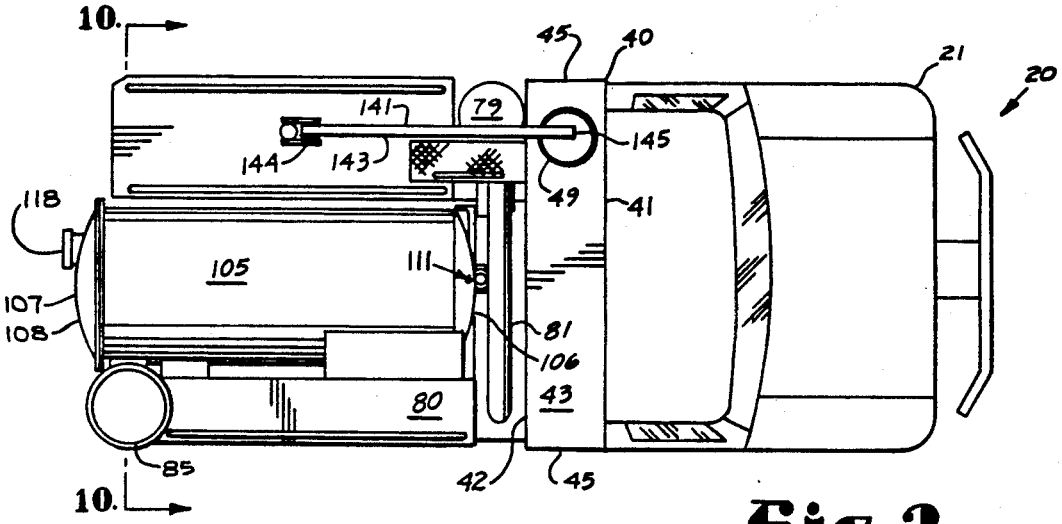
FIG. 3 is a top plan view of the excavation apparatus.

A suction tank 105 is tiltably mounted on the chassis 31 and includes front and back ends 106, 107. The tank back end 107 is selectively closed by a hatch 108. The suction tank 105 is pivotably mounted at its back end 107 on the chassis 31. A hydraulic jack subassembly 111 interconnects the chassis 31 and the tank front end 106 and is adapted for raising and lowering the suction tank 105 between a lowered, operating and travel position (FIG. 1) and a raised, dump position (FIG. 2).

A hydraulic piston-and-cylinder unit 114 is mounted on the suction tank 105 and is connected to its hatch 108 through hinge linkage 115 whereby the hatch 108 can be hydraulically opened and closed. Large diameter and small diameter inlets 118, 119 are provided in the hatch 108 and communicate with an interior of the suction tank 105. An outlet 120 communicates the suction tank 105 with the separator inlet 100 by means of a tank-separator duct 121.

Figure 6:
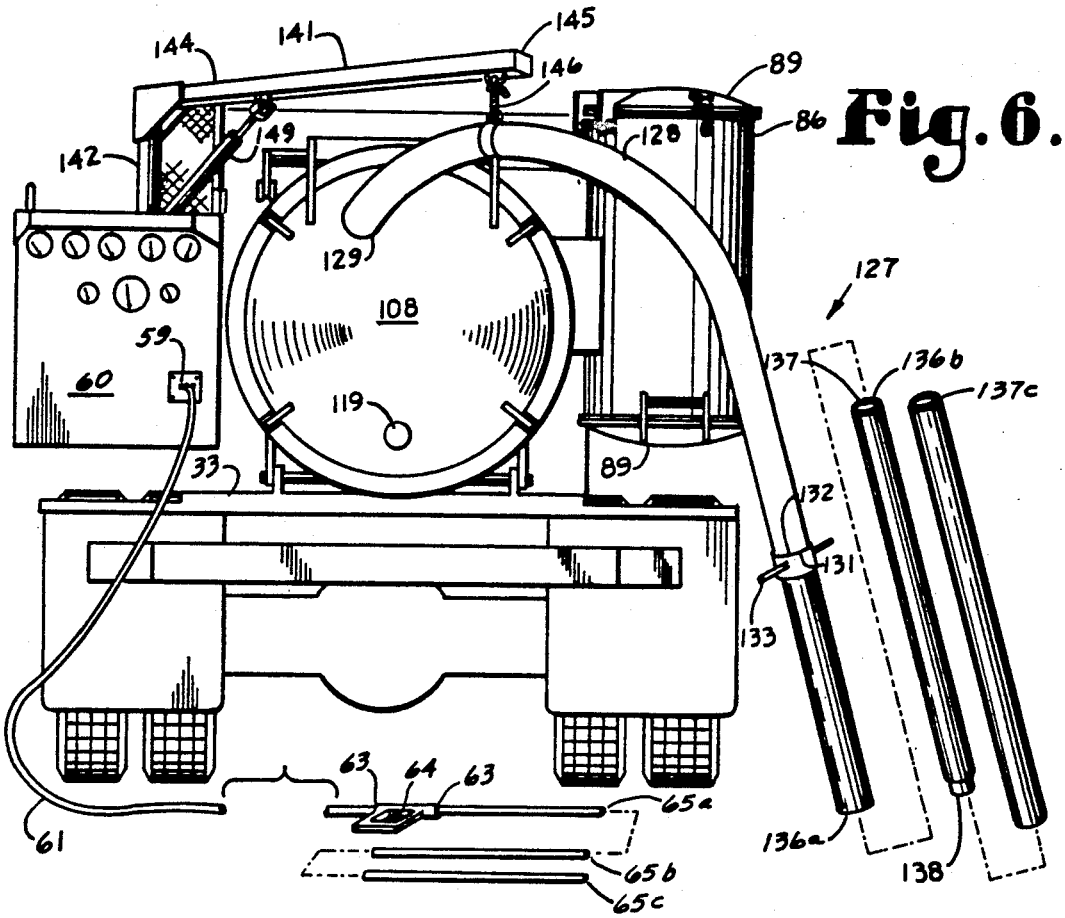
FIG. 6 is a rear elevational view thereof with a spray wand and a suction hose attached.
Figure 7:
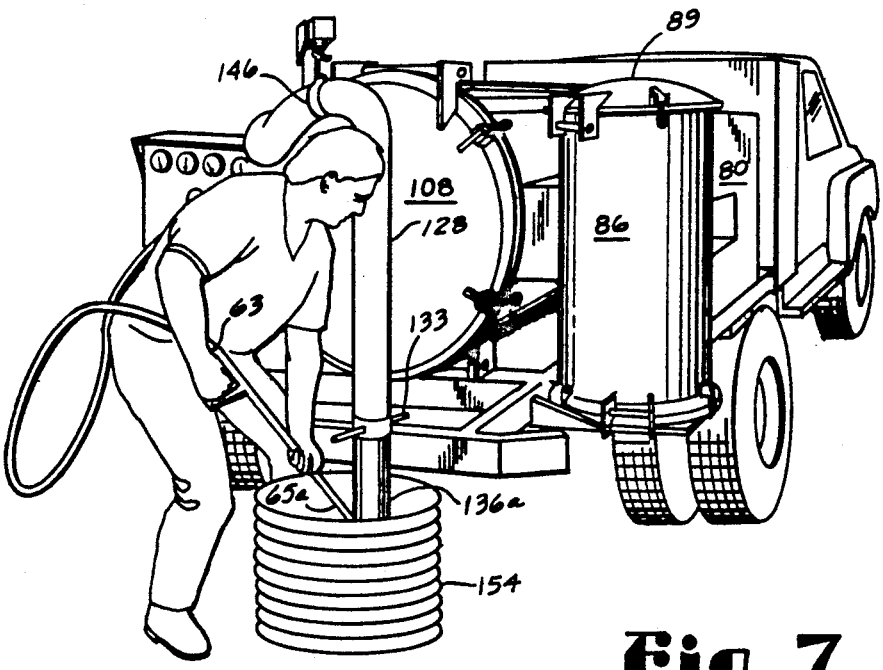
FIG. 7 rear perspective view thereof showing the suction hose and the spray wand in use.
Figure 8:
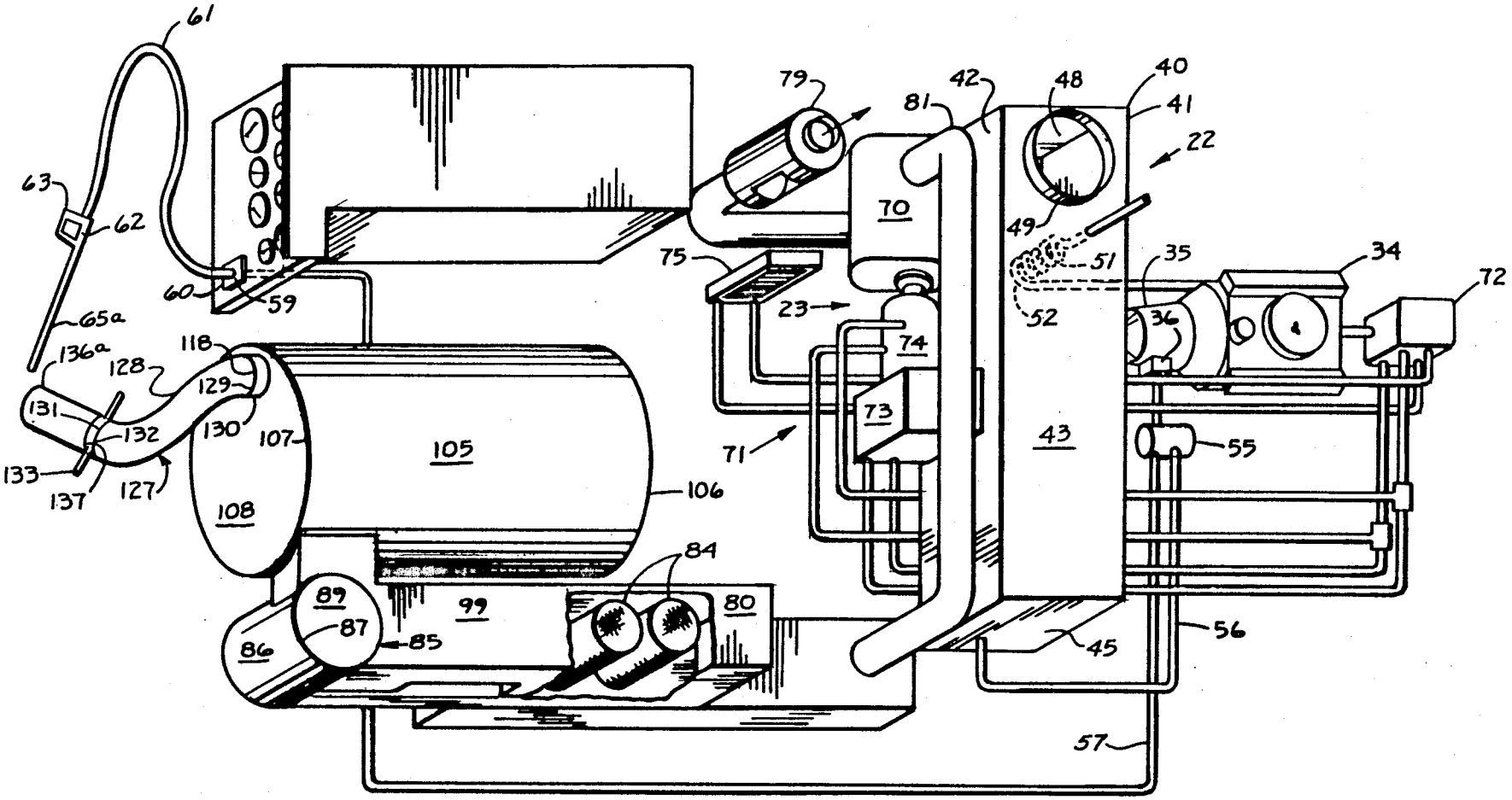
FIG. 8 is a schematic view thereof showing a hydraulic jet system and a suction system.
Figure 9:
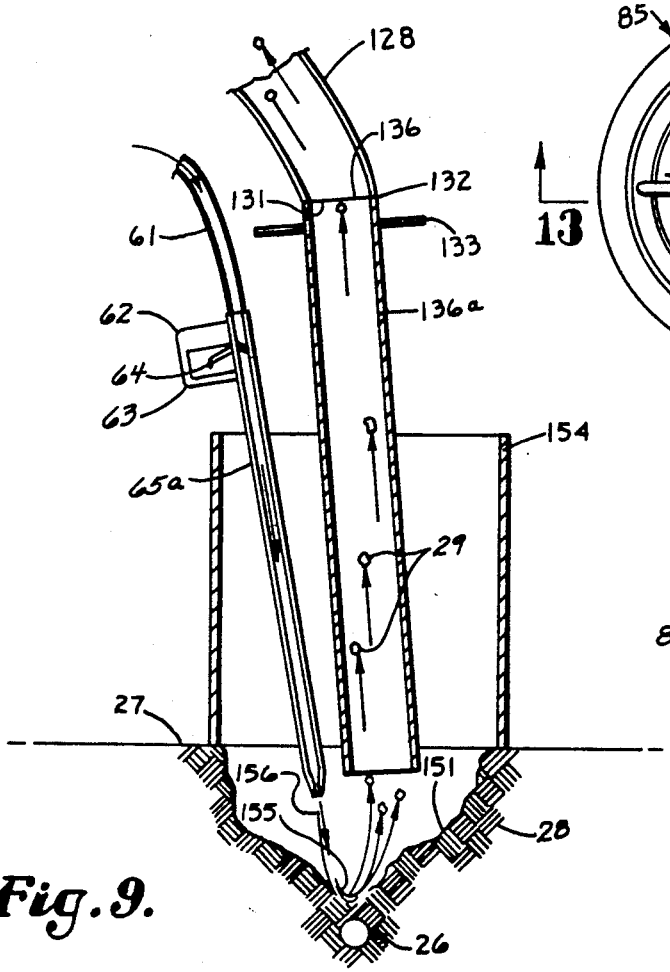
FIG. 9 is an enlarged, fragmentary cross-sectional view of portions of the excavation apparatus in use for exposing a subsurface cable.

A baffle subassembly 124 is provided on the inside of the tank 105 in covering relation over the tank outlet 120. A suction hose assembly 127 includes a flexible hose section 128 with a proximate end 129 with a coupling 130 for releaseable coupling to the suction tank inlet 118 and a distal end 131 mounting a distal coupling 132. A handle subassembly 133 is clamped on the flexible hose section 128 adjacent to its distal end 131. A rigid suction hose section 136 includes a proximate end 137 attached to the flexible hose section distal end 131 by the distal coupling 132 and a distal end 138. As shown in FIG. 6, short, medium and long rigid suction hose sections 136 are provided and may be interchangeably coupled individually or in groups to the flexible hose section 128.

A boom assembly 141 includes a boom column 142 pivotably mounted on the vehicle 21 and adapted for rotation about a vertical rotational axis. A boom arm 143 includes a proximate end 144 mounted on the boom column 142 and pivotable with respect thereto about a horizontal pivotal axis whereby the boom arm 143 is adapted for raising and lowering. The boom arm 143 also includes a distal end 145 with a mounting member 146 for releaseable attachment to the suction hose flexible section 128.

A boom jack comprising a piston-and-cylinder unit 149 is connected to the column 142, the boom arm 143 and a pressurized fluid source (not shown) and is adapted for raising and lowering the boom arm 143.

V. Operation

Without limitation on the generality of useful applications for the excavation apparatus 20, a disclosed method involves locating a cable 26 buried within an earthen mass 28 below a ground surface 27. The cable 26 may be located in, for example, a right-of-way, the boundaries of which may be marked whereby the general location of the cable 26 can be determined. Other preliminary sources of information concerning the location of the cable 26 may include cable installation records, visual reference to the adjacent manholes and various techniques that are commonly used in the surveying.

The excavation process primarily involves hydraulically cutting an excavation opening 151 in the earthen mass 28 with the spray wand 62, and withdrawing the dislodged earthen mass particles 29 from the excavation opening 151 with the suction hose assembly 127. These steps can be undertaken simultaneously.

If desired, an open-ended, cylindrical splatter shield 154 can be placed over the location of the excavation opening 151 to control splattering caused by the hydraulic action of the spray wand 62. As the depth of the excavation opening 151 increases, there may be less need for the splatter shield 154 since the cutting area 155 would be a considerable distance below the ground surface 27 whereby the earthen mass 28 would somewhat shield the operator.

The spray wand 62 is operated by pressing the valve trigger 64 which opens a valve in the spray wand barrel 65 whereby a cutting stream 156 of water is discharged from the nozzle 66 to the cutting area 155. The hydraulic jet system pump 55 is driven by the vehicle engine 34 through its transmission 35 and the power takeoff 36, whereby the output of the hydraulic jet system 22 can be controlled with the speed of the engine 34. Other means for controlling the discharge force and rate of the hydraulic jet system 22, such as flow-restrictive valving, etc. could also be provided. As an example, the hydraulic jet system 22 may produce water pressures of approximately three thousand pounds per square inch (PSI) at a flow rate of approximately four gallons per minute, for which the power requirements are estimated at twenty to thirty horsepower.

The suction system 23 is powered by the vehicle engine 34 indirectly through the hydraulic blower drive system 71. As an example, the suction system 23 can be designed to draw approximately two thousand cubic feet per minute (CFM) of air while utilizing approximately seventy to one hundred horsepower.

The exhaust pipe section 52 which extends through the liquid reservoir 40 functions to transfer some of the engine exhaust heat energy that would otherwise be lost to the liquid L. Thus, water can be used in conditions where it might otherwise freeze and the running of the vehicle engine 34 will serve to at least partially heat it.

The suction system 23 draws dislodged particles 29 and liquid L from the excavation opening 151 through the suction hose assembly 127. When the airstream from the suction hose assembly 127 enters the suction tank 105, most of the liquids and solids will fall to a lower part of the suction tank 105. The location of the suction tank outlet 120 at an upper part of the suction tank 105 functions to restrict the amount of the liquids and solids that are drawn from the suction tank 105. The baffle subassembly 124 also functions to prevent some of the solids particles from leaving the suction tank 105 through the outlet 120.

The separator subassembly 85 further separates solids and liquids from the suction airstream which enters its inlet 100 from the tank-separator duct 121. In the separator lower chamber 97, a vortex may created around the separator tube 92 with the suction airstream moving in a generally downward direction. Much of the liquids and solids will fall from the airstream in the lower chamber 97. The airsteam enters the separator tube 92 through its open lower end 94. The suction air stream is drawn upwardly through the separator tube 92 and passes through the conical filter or screen 98 as it leaves the separator tube open upper end 93 and enters the upper chamber 96.

The separated and screened airstream leaves the separator tube upper chamber 96 through the outlet 99 for the bag filter subassemblies 84, which serve to further filter the suction airstream. From the bag filters subassemblies 84 the airstream is drawn to the blower 70 and then discharged to the atmosphere through the suction system discharge 79.

The suction tank 105 is emptied by opening the rear hatch 108 with the piston-and-cylinder unit 114 and by raising the suction tank front end 106 with the jack assembly 111. A vibrator 159 is mounted on the bottom of the suction tank for vibrating the contents thereof to facilitate maintaining the solids materials in suspension in the liquid, and also to facilitate discharging as much material as possible when the suction tank 105 is tilted in its opened configuration.

The solids and liquids collected in the separator subassembly 85 may be discharged by opening the lower hatch 89. The filter or screen 98 in the separator upper chamber 96 is accessible through the upper hatch 89 for cleaning or replacement. The bag filter subassemblies 84 may also include removable bag filter elements for cleaning or replacement. The suction system 23 could also be back flushed by reversing the operative configuration of its blower 70.

As the excavation opening 151 is extended, spray wand extension barrel sections 65*a, b, c* may be added to the spray wand 62 to enable an operator on the ground surface 27 to excavate at depths of, for example, ten feet or more. The suction hose sections 136*a, b* and *c* may also be used individually and in combinations to draw material and liquids from excavations of various depths.

It is to be understood that while certain forms of the present invention have been illustrated and described herein, it is not to be limited to the specific forms or arrangement of parts described and shown.

What is claimed and desired to be secured by Letters Patent is as follows:

1. An excavation apparatus, which comprises:

(a) vehicle means adapted for transporting said excavation apparatus and including an engine;

(b) a liquid jet system including:

(1) liquid source means;

(2) a liquid pump mounted on said vehicle and drivingly connected to said vehicle engine; and (3) a liquid spray wand connected to said pump and including a spray nozzle;

(c) a suction system including:

(1) a blower subsystem drivingly connected to said engine;

(2) a suction tank having an outlet pneumatically communicating with said blower and an inlet; and (3) a suction hose connected to said suction tank and communicating with said inlet; and (d) said suction tank including a first end, an open second end, a hatch adapted for selectively covering the storage tank second end, and said suction tank being tiltable with respect to said vehicle means whereby said storage tank first end is raised for discharging the contents of said suction tank through its open second end.

2. The excavation apparatus according to claim 1 wherein said blower subsystem includes:

(a) a hydraulic pump adapted to be drivingly connected to said engine;

(b) a hydraulic motor hydraulically communicating with said hydraulic pump; and (c) a pneumatic blower adapted to be driven by said hydraulic motor.

3. The excavation apparatus according to claim 2 wherein said pneumatic blower comprises:

(a) a double-lobe, positive-displacement blower.

4. The excavation apparatus according to claim 1 wherein said suction system includes:

(a) a filter subassembly in series and pneumatically communicating with said suction tank and said blower subsystem.

5. The excavation apparatus according to claim 4 wherein said filter subassembly includes:

(a) a housing forming an air duct passage; and (b) a bag filter mounted on said housing within said air duct passage.

6. The excavation apparatus according to claim 5 wherein said suction system includes:

(a) a liquid and air separation subsystem including a separator vessel with an inlet communicating with said suction tank, an air outlet communicating with said filter subassembly and a liquid and solids outlet; and (b) said separator subsystem being adapted for receiving liquids, solids and air from said suction tank and dispensing primarily air through said air outlet and dispensing liquid and solids through said liquid and solids outlet.

7. The excavation apparatus according to claim 1 wherein:

(a) said suction tank includes a closed first end and an open second end; and (b) said suction tank includes a hatch adapted for selectively covering said storage tank second end.

8. The excavation apparatus according to claim 1 wherein said suction system includes:

(a) a hydraulic jack adapted for raising said suction tank first end.

9. The excavation apparatus according to claim 1 wherein: said liquid jet system includes:

(a) said liquid source means comprising a liquid tank mounted on said vehicle.

10. The excavation apparatus according to claim 9 wherein said liquid jet systems includes:

(a) heater means adapted for heating the liquid contents of said liquid reservoir.

11. An excavation method, which comprises the steps of:

(a) forming a liquid jet by pumping a liquid through a liquid dispenser;

(b) dislodging ground material with said liquid jet;

(c) creating a partial vacuum in a suction tank;

(d) drawing at least a portion of said dislodged material and at least a portion of said dispensed liquid into said suction tank;

(e) mounting said suction tank on a vehicle; and (f) selectively opening said suction tank and tilting said suction tank with respect to said vehicle and discharging the contents of said suction tank.

12. The excavation method according to claim 11, which includes the additional step of:

(a) simultaneously discharging said liquid and creating said partial vacuum.

13. The excavation method according to claim 12 which includes the additional steps of:

(a) simultaneously driving said liquid pump and a blower subsystem pneumatically communicating with said suction tank by a vehicle engine.

14. The excavation method according to claim 11, which includes the additional step of:

(a) removing air from said suction tank with a blower subsystem.

15. The excavation method according to claim 11, which includes the additional step of:

(a) drawing air with said blower subsystem through a filter subassembly from said suction tank.

16. The excavation method according to claim 11, which includes the additional step of:

(a) providing a spray wand communicating with said liquid pump for forming said water jet; and (b) providing a flexible suction hose in communication with said suction tank.

17. The excavation method according to claim 15, which includes the additional step of:

(a) at least partially separating air from liquid and solid matter between said suction tank and said filter subassembly.

18. The excavation method according to claim 16, which includes the additional step of:

(a) removably attaching suction hose extensions of different lengths to said suction hose.

19. The excavation method according to claim 16, which includes the additional step of:

(a) removably attaching spray wand extensions of differents lengths to said spray wand.

20. An excavation apparatus, which comprises:

(a) vehicle means adapted for transporting said excavation apparatus and including an engine;

(b) a liquid jet system including:

(1) liquid source means;

(2) a liquid pump mounted on said vehicle and drivingly connected to said vehicle engine; and (3) a liquid spray wand connected to said pump and including a spray nozzle;

(c) a suction system including:

(1) a blower subsystem drivingly connected to said engine;

(2) a suction tank having an outlet pneumatically communicating with said blower and an inlet; and (3) a suction hose connected to said suction tank and communicating with said inlet;

(d) said liquid source means comprising a liquid tank mounted on said vehicle; and (e) said liquid jet system including heater means adapted for heating the liquid contents of said liquid tank and comprising an exhaust pipe from said vehicle engine connected to said liquid tank in a heat exchange relationship with the contents thereof.

* * * * *